US008646639B2

(12) United States Patent
Pils et al.

(10) Patent No.: US 8,646,639 B2
(45) Date of Patent: Feb. 11, 2014

(54) DEVICE FOR UNLOCKING SWING-ACTION SIDE WALLS OF BOXES AND/OR CONTAINERS

(75) Inventors: Volker Pils, Weitefeld (DE); Diethelm Hirz, Neunkirchen (DE)

(73) Assignee: Fritz Schaefer GmbH, Neunkirchen (DE)

( * ) Notice: Subject to any disclaimer, the term of this patent is extended or adjusted under 35 U.S.C. 154(b) by 174 days.

(21) Appl. No.: 13/379,596

(22) PCT Filed: Jul. 15, 2010

(86) PCT No.: PCT/EP2010/004305

§ 371 (c)(1),
(2), (4) Date: Jan. 4, 2012

(87) PCT Pub. No.: WO2011/006654

PCT Pub. Date: Jan. 20, 2011

(65) Prior Publication Data

US 2012/0111859 A1 May 10, 2012

(30) Foreign Application Priority Data

Jul. 15, 2009 (DE) ..... 10 2009 033 108

(51) Int. Cl.
*B65D 6/18* (2006.01)

(52) U.S. Cl.
USPC ..... 220/7; 220/6; 220/666; 220/4.28

(58) Field of Classification Search
USPC ..... 220/6, 7, 4.28, 666
See application file for complete search history.

(56) References Cited

U.S. PATENT DOCUMENTS 5,632,392 A * 5/1997 Oh ..... 220/7
5,853,099 A * 12/1998 Lessard ..... 220/7

(Continued)

FOREIGN PATENT DOCUMENTS

DE 9113549 U 4/1992
EP 1935792 A 6/2008

(Continued)

*Primary Examiner* — Stephen Castellano
(74) *Attorney, Agent, or Firm* — Andrew Wilford

(57) ABSTRACT

The invention relates to a device for unlocking swing-action side walls (2 to 5) which are hinged on the base (6) of boxes and/or containers (1), of which the two opposite end walls (4, 5) can be locked to the two adjacent side walls (2, 3) and unlocking takes place by virtue of a lifting movement of a bracket-like actuator (13), which interacts with a movement-deflecting means (16, 17), and wherein unlocking crosspieces (19) act on spring-tongue-like locking means (10) of the side walls (4, 5), these locking means being latched into the end walls (2, 3), and force them out of their latching seat, in which they clamp the end walls (2, 3). According to the invention, the actuator (13) is arranged in a sliding wall element (26) which can be displaced vertically parallel to the end wall (4, 5) in an upwardly open wall cutout of the end wall (4, 5), in lateral guides (25*a*, 25*b*) of the wall cutout, these guides continuing the end wall (4, 5), into a position in which it closes the wall cutout or releases the same, and wherein, during displacement movements of the sliding wall element (26), the movement-deflecting means (17, 18, 19), which interact with the ends of the actuator (13), remain in their installation position in the end wall (4, 5) laterally adjacent to the wall cutout.

16 Claims, 8 Drawing Sheets

(56) References Cited

U.S. PATENT DOCUMENTS

| | | | | |
|---|---|---|---|---|
| 6,290,081 | B1 | 9/2001 | Merey | |
| 7,011,225 | B2 | 3/2006 | Oster | |
| 7,159,730 | B2 * | 1/2007 | Rumpel | 220/7 |
| 7,195,128 | B2 * | 3/2007 | Murakami et al. | 220/7 |
| 7,861,878 | B2 | 1/2011 | Escarpa Gil | |
| 8,469,216 | B2 * | 6/2013 | Pils | 220/7 |
| 2004/0069780 | A1 * | 4/2004 | Apps et al. | 220/7 |
| 2006/0231555 | A1 * | 10/2006 | Smyers et al. | 220/6 |
| 2008/0142530 | A1 | 6/2008 | Meers | |
| 2010/0294757 | A1 | 11/2010 | Pils | |

FOREIGN PATENT DOCUMENTS

| | | | |
|---|---|---|---|
| EP | 1970315 | A | 9/2008 |
| EP | 2141081 | A | 1/2010 |
| WO | 2009100799 | A | 8/2009 |

* cited by examiner

DEVICE FOR UNLOCKING SWING-ACTION SIDE WALLS OF BOXES AND/OR CONTAINERS

CROSS REFERENCE TO RELATED APPLICATIONS

This application is the US-national stage of PCT application PCT/EP2010/004305 filed 15 Jul. 2010, published 20 Jan. 2011 as WO2011/006654, and claiming the priority of German patent application 102009033108.5 itself filed 15 Jul. 2009, whose entire disclosures are herewith incorporated by reference.

The invention relates to a device for unlatching foldable side walls of boxes or containers, wherein the side walls are hinged to the base whose two opposite end walls can be latched to the adjacent side walls and the unlatching is carried out by lifting Arcuate actuating handles mounted and guided, resiliently prestressed, on outer faces of the end walls, motion-redirecting means on two outer ends of the actuating handle having handle ends projecting upward in the lifting direction, the motion-redirecting means converting vertical movement of lifting of the actuating handle into a horizontal movement unlatching the side walls in that unlatching arms acting on spring-tongue latches of the side walls snapped into the end walls press them out of their engaged seat surrounding the end walls.

Through the generic device known from an earlier application, the disadvantages of the containers known from, for example DE 91 13 549.4 or DE 101 37 328 [U.S. Pat. No. 7,011,225] can be avoided, in that a system separation is rendered possible because the latching is always ensured by the latching means provided in the side walls adjacent the end walls and not dependent on a resilient biasing of the Arcuate actuating handle. Due to the upstream motion redirection, the actuating handle only unlatches, but does not latch.

In any case the functionality of the container with foldable or collapsible walls can thus be ensured because even in the case of breakage or damage to the one-hand unlatching mechanism, the latching of the raised walls is maintained unchanged. The unrestricted functionality applies likewise to the unlatching for collapsing the container walls, since the unlatching can be individually cancelled by hand even without the one-hand latch. For this it is necessary merely to strike the end walls from outside, so that the latching means of the side walls slide out of the engagement seat.

Such foldable or collapsible containers are used for order picking of various goods in storage racks and external logistics. The storage racks have several rack levels in which the order picking containers are stored. The containers of the lower to middle rack levels that are at eye level can be viewed easily by an operator. On the one hand it can thereby be recognized in good time how much content is still available in the container. On the other hand, it is easy to reach into the containers to remove goods or to fill the containers with goods. The containers that are located in the upper levels, however, are usually difficult to view by the operator. Due to the high container wall, furthermore reaching into the container is additionally impeded. These conditions have resulted in that in many rack systems the uppermost rack levels are often not stocked with containers. Instead, there is a distribution over the width of the middle to lower rack levels, which automatically lengthens the distances for an operator, productivity declines and in addition more rack width is needed.

In practice, foldable or collapsible containers are known with which these disadvantages can be avoided by providing an order picking opening. For this purpose virtually an entire end wall, apart from a surrounding frame, can be pivoted open about its hinges as a flap in the direction away from the container. However, as a result, other disadvantages then occur. The end wall pivoted away or folded up can cover or obscure a light fixture of the rack system and, moreover, it cannot be ruled out that the end wall or flap will open during transport, so that there is a risk that the container will jam during conveyance on an automatic transport system.

The object of the invention is therefore to create a container which, while utilizing and retaining the advantages of the subject matter of the main application, at the same time provides a unloading opening that meets all requirements without the described disadvantages of the containers known from the art.

This object is attained according to the invention in that the actuating handle is mounted on a sliding wall panel that can be displaced in an upwardly open cutout of the end wall in lateral guides of the wall cutout that extend vertically on the end wall into positions closing or exposing the wall cutout), and wherein the motion-redirecting means interacting with the handle ends of the actuating handle during displacement of the sliding wall panel in their assembly position in the end wall remain laterally adjacent the wall cutout The sliding wall panel can thus adopt at least two different positions, namely the upper end position filling the wall cutout and thus closing the end wall or the container. On the other hand, in a lower end position, the wall cutout is exposed and thus there is unimpeded access to the interior of the container, so that even with a container placed in an upper rack level, a free view is ensured and easy access to the contents is made possible.

When the sliding wall panel is in the lower end position, that is with free access to the interior of the container, according to the invention undesirable collapsing of the container is prevented in any case. The actuating handle namely has no contact to the unlatching elements remaining adjacent to the wall cutout in the end wall, which means the function as safety closure is unrestrictedly fulfilled. If, however, the container is to be collapsed for empty transport, the side wall panel needs only be pushed into the upper end position filling the wall cutout. In the sequence of motions of pushing upward, the one-hand actuating handle with its handle ends automatically comes into contact with the end wall-side unlatching elements, so that the latching or engagement seat thereof with the end walls is cancelled by raising just the actuating handle and as a result all of the container walls can be folded inward about their hinges.

According to a preferred embodiment of the invention, the handle ends are each formed with an actuating formation running at an angle to the vertical and engageable with complementarily angled U-shaped guides of unlatching elements mounted on the left and right in the end wall. When the actuating handle is actuated by hand, after the sliding wall panel is in the upper end position, the actuating formations of the handle ends automatically slide upward in the U-shaped profiles as a result of this lifting motion, and these parts are displaced relative to one another, by which action the unlatching element is moved horizontally outward parallel to the side walls overlapping the end walls in one section in a skirt-like fashion. The conversion of motion from the vertical actuating-handle movement into horizontal movement of the unlatching element directed to the side wall is carried out via the angled surfaces of the actuating formations and the U-shaped guides being displaced toward one another, this engagement corresponding to a tongue and groove connection, so that as a result the end walls are unlatched from the side walls.

To accomplish this according to one proposal of the invention, the unlatching elements, starting from their U-shaped guides engageable with actuating formations, are each provided with an unlatching arm or unlatching tongue projecting from it horizontally and acting on spring tongues that are formed in the respective corners of the adjoining side walls, projecting against the end walls and locked therein. To unlatch the end walls, the spring tongues are pressed horizontally outward during vertical lifting of the actuating handle and the thus initiated motion redirection of the unlatching elements by the unlatching arms or unlatching tongues. The end walls thus unlatched can then be folded inward onto the base via their hinges connected to the base of the box or container and the side walls can then be folded thereover.

According to a further embodiment of the invention, each horizontal unlatching arm is formed with spring arms on its upper and its lower faces, the spring arms bearing in the horizontal and in the vertical direction on reinforcement ribs inside the end wall. When the Arcuate actuating handle is released, the spring arms that are molded on in the transition region between the U-shaped guide of the unlatching element and the unlatching arm automatically return the unlatching element with the unlatching arm to the starting position before unlatching due to the resetting forces created by the deformation of the spring arms during the prior vertical actuation of the actuating handle.

An advantageous proposal of the invention provides that the sliding wall panel has a flexible handle recess molded on its lower end, which handle recess is formed with an overhang projecting inward into the container, which overhang, in the position closing the wall cutout, lies on the horizontal end edge of the wall cutout. As long as the overhang that is angled upward and outward in a wedge-shaped manner according to one embodiment of the invention, bears against the end edge with its lower, wide wedge face, the position closing the wall cutout is secured.

If an operator then pulls on the handle recess advantageously mounted between two vertical slots in the sliding wall panel, the overhang clears the horizontal end edge, so that the sliding wall panel can be displaced parallel to the end wall into a desired position.

The invention provides a stop mounted above the handle recess approximately in the center between the vertical slots, establishing the maximum freedom of movement of the handle recess with tensile impingement. The handle recess thus cannot be overstretched, since the stop, which then bears against the sliding wall panel with its upper end edge, blocks a further pulling away of the handle recess.

If preferably a recess in the end wall can receive the overhang in the lower end position of the sliding wall panel, not only is the overhang being permanently under stress avoided, that is, being permanently pushed forward, the sliding wall panel cannot be displaced unintentionally into another position either, for example when the container is held upside down or while shaken during transport on automatic conveyor paths.

According to one proposal of the invention, straight ridges orthogonal to the vertical slots on the inside of the sliding wall panel are provided at the height of the surface of the overhang bearing on the end edge of the wall cutout. These prevent the sliding wall panel, released by pulling on the handle recess from the horizontal end edge of the wall cutout, from sliding downward in a freely moveable manner. For displacement, the small ridge providing minimal resistance is overcome.

A further embodiment of the invention provides that the sliding wall panel has full-height guide grooves open inward and spaced apart from one another and aligned with respective vertical ribs formed on the outside of the end wall extending up to the lower edge thereof and engaging into the guide grooves. The lateral guides delimiting the wall cutout are hereby supported and tilting which can be caused, for example, by shaking during automatic conveyor path transport is avoided.

A preferred embodiment of the invention provides that the lateral guides of the end wall at the upper end of the wall cutout are formed with respectively offset support shoulders facing toward one another and formed with downwardly open cavities into which can engage sliding wall lugs molded on the upper corners of the sliding wall panel in the raised end position. During the transport of loaded containers, which for this purpose are grasped by the handles in the side wall panels of the end walls, an optimal introduction of force and distribution of force can thus be achieved therewith.

According to one embodiment of the invention, one lateral guide is formed over part of its height below the wall cutout with an inset. The sliding wall panel can be preassembled with the actuating handle by being inserted in a one-sided manner into this inset providing a pocket-like free space and thereafter also inserted into the opposite lateral guide in the opposite direction.

It is proposed that the lateral guides and the sliding wall panel are provided with holes that in the raised end position of the side wall panel run flush for attachment of an antitamper seal. This sealing makes theft protection possible.

According to another proposal of the invention, the sliding wall panel is provided with throughgoing slots to accommodate mounting heads of the actuating handle. The opening widths which thus differ permit the insertion of the hook-shaped mounting heads, but subsequently prevent them from being able to exit from the recesses by themselves. If the container is collapsed and is then to be automatically assembled by a robot, the throughgoing slots can simultaneously serve as an engagement possibility for the robot in order to erect the end wall.

Further features and details of the invention are given by the claims and the following description of an embodiment of the invention shown in the drawings. Therein:

Figure 1:
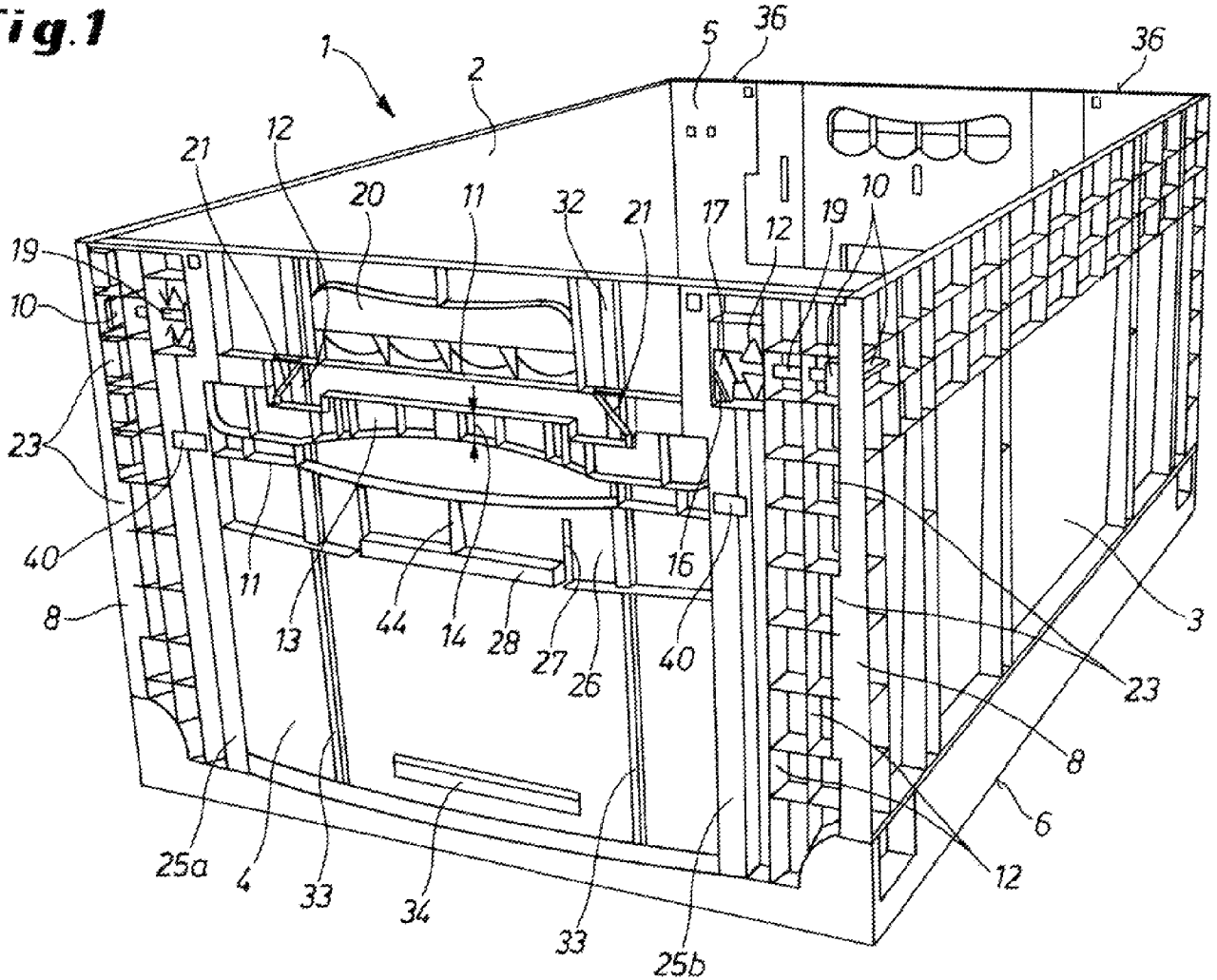
FIG. 1 is an overall perspective view of a container according to the invention with erected and latched side walls viewed from an end wall, where each end wall has a sliding wall panel that is provided with an actuating handle of a one-hand latch.
Figure 8:
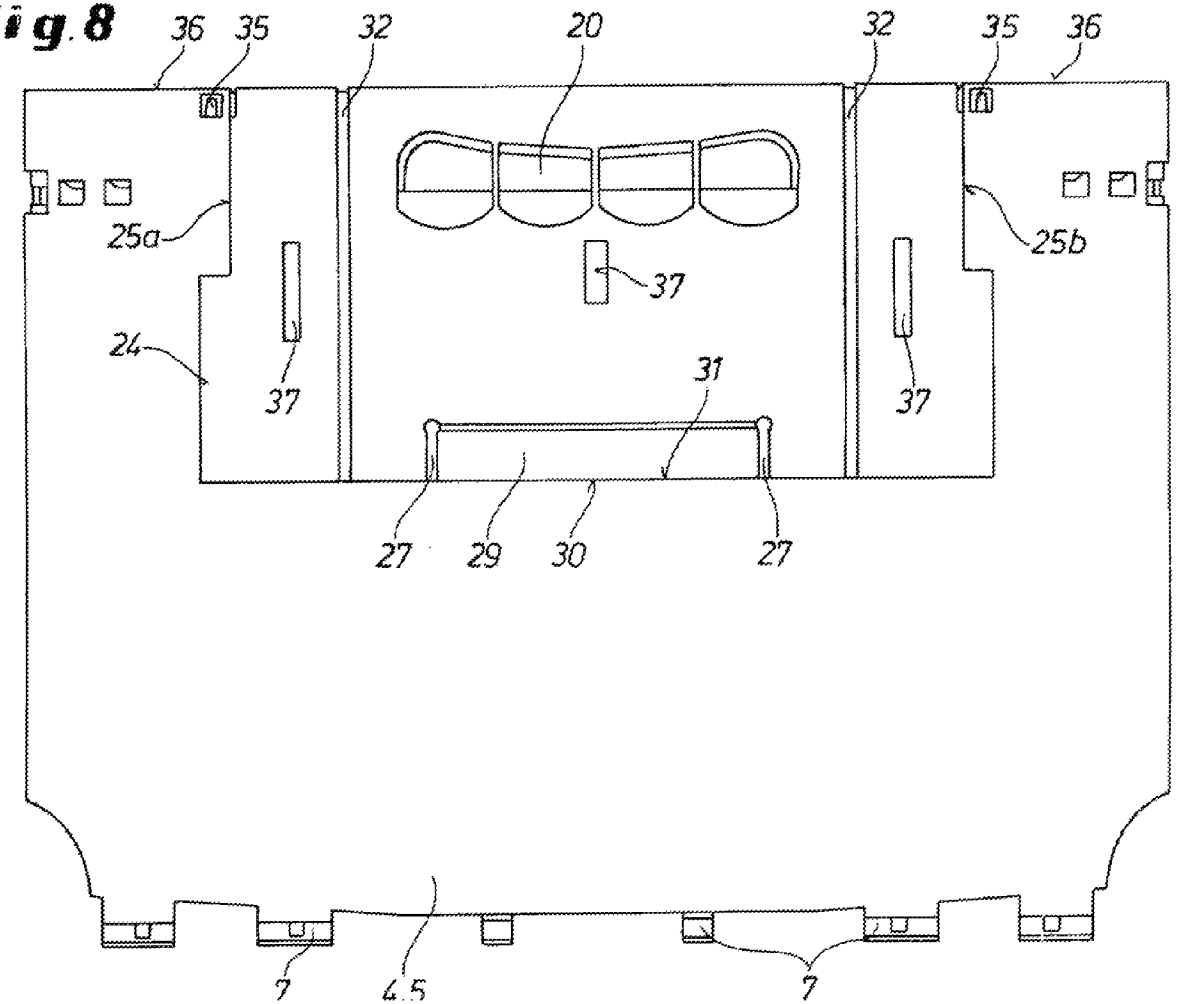
FIG. 8 is an inside detail view of the end wall with the sliding wall panel in the upper end position.

FIG. 1 shows a container 1 having four side walls 2 through 5. The two side walls 2 and 3 as well as the two end walls 4 and 5 are mounted so they can be folded inward onto the container base 6. To this end, hinges 7 or hinge elements are molded onto the lower edges of the end walls 4 and 5 (see FIG. 8), via which the end walls 4 and 5 can be fitted to the container base 6 that has complementary hinge fittings. The side walls 2 and 3 are also provided on their lower edges with respective hinges 7 that fit with complementary hinge halves of the container base 6. The hinges of the side walls 2 and 3 are above the hinges 7 of the end walls 4 and 5 so that the side walls 2 and 3 can be folded down atop the end walls 4 and 5 that have been previously folded down onto the container base 6.

Figure 4:
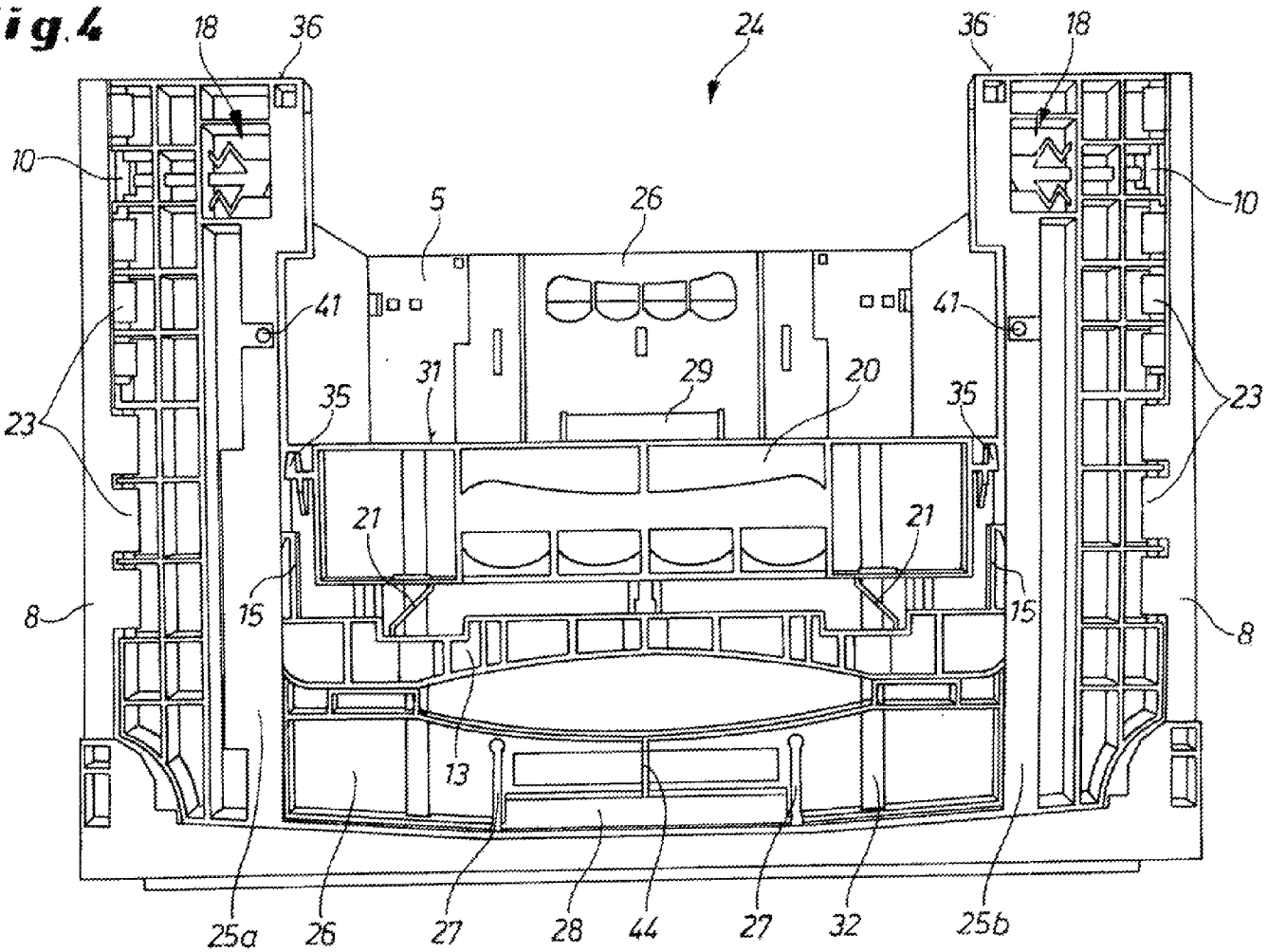
FIG. 4 is a perspective end wall view of the complete container with free unloading opening in the front end wall and sliding wall panel pushed into the lower end position.

The corners of the side walls 2 and 3 are each formed with skirt-like offsets or flanges 8 slightly overlapping the side edges of the end walls 4 and 5. In the upright position, the end walls 4 and 5 bear outwardly against the flanges 8, fitting with locking ribs 23 projecting inward from the flanges 8, which locking ribs clamp around opposite rib-like counter-locking means of the end walls 4 and 5 (see also FIG. 4).

Where the side walls 2 and 3 meet the flanges 8, spring tongues 10 project from the flanges 8 of the side walls 2 and 3 toward the end walls 4 and 5 (see FIG. 4). When the end walls 4 and 5 are folded up or folded open, they are automatically latched as the spring tongues 10 snap into the side walls 2 and 3 or their flanges 8.

Figure 3:
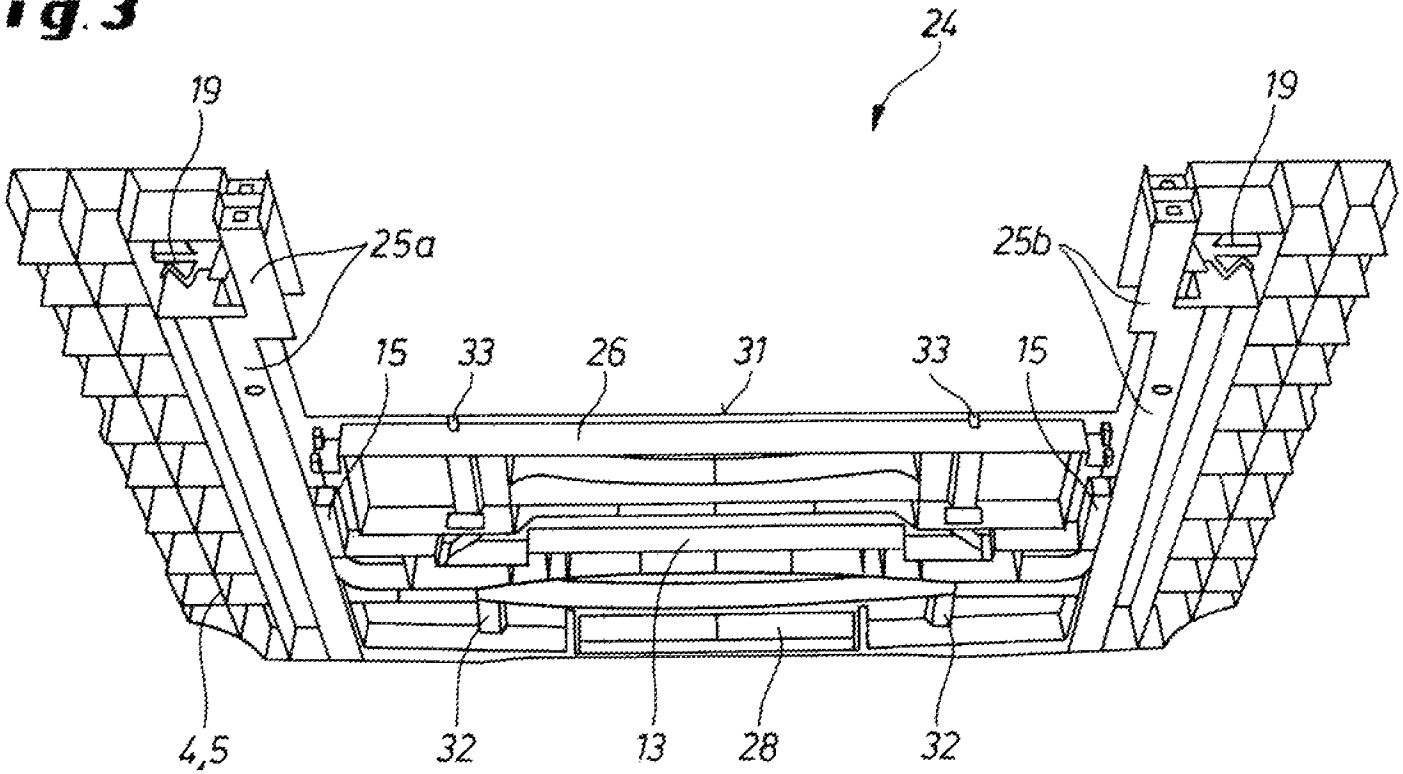
FIG. 3 shows the end wall as in FIG. 2 with the sliding wall panel pushed down and exposing the container unloading opening.

The end walls 4 and 5 are each formed with a cutout 24 (see FIGS. 3, 4 and 8) open at the top of the container and extending part-way down. Respective sliding wall panels 26 are held in lateral guides 25*a* and 25*b* delimiting the wall cutouts 24 and continuing to lower edges of the respective end walls 4 and 5 such that each wall panel can be displaced parallel to the respective end wall 4 and 5 between an upper position closing the respective wall cutout 24 and a lower position (FIGS. 3, 4) exposing the respective unloading opening for access to the interior of the container.

To this end, an actuating element 13 is mounted on the outer surface of each of the sliding wall panels 26 that is provided with horizontal reinforcement ribs 11 and with vertical reinforcement ribs 12, each actuating element being formed as an arcuate handle. This actuating handle 13, extending essentially over the full width of the wall cutout 24 between the lateral guides 25*a* and 25*b*, has handle ends 15 projecting vertically upward (see FIG. 5 and FIG. 6) and engaging in free spaces between the reinforcement ribs 11 and held thereby with engagement in the lateral guides 25*a* and 25*b* as well as guided therein also in the direction 14, that is the lift or movement direction.

The actuating handle 13 is formed at each of its two ends 15 with an actuating formation 16 projecting at an acute angle to the vertical. The actuating formations 16 in turn can engage complementarily angled U-shaped guides 17 of respective unlatching elements 18 on the right and left side of the wall cutout 24 in the end walls 4 and 5. The unlatching elements 18, starting from their U-shaped guides 17 accommodating the actuating formations 16, are each provided with a horizontally extending unlatching arm 19. The unlatching arms 19 extend horizontally through the vertical reinforcement ribs 12 of the end walls 4 and 5 and, during an unlatching operation described in more detail below, act on the spring tongues 10 projecting toward the end walls 4 and 5.

The actuating handle 13, guided and held along the lower edge of a conventional grip 20 of the sliding wall panel 26, is resiliently biased downward by spring tabs 21 directed toward one another on the left and on the right on the actuating handle 13. These spring tabs 21 are braced at their free ends against a horizontal reinforcement rib 11 of the sliding wall panel 26 or are hooked therein.

Figure 5:
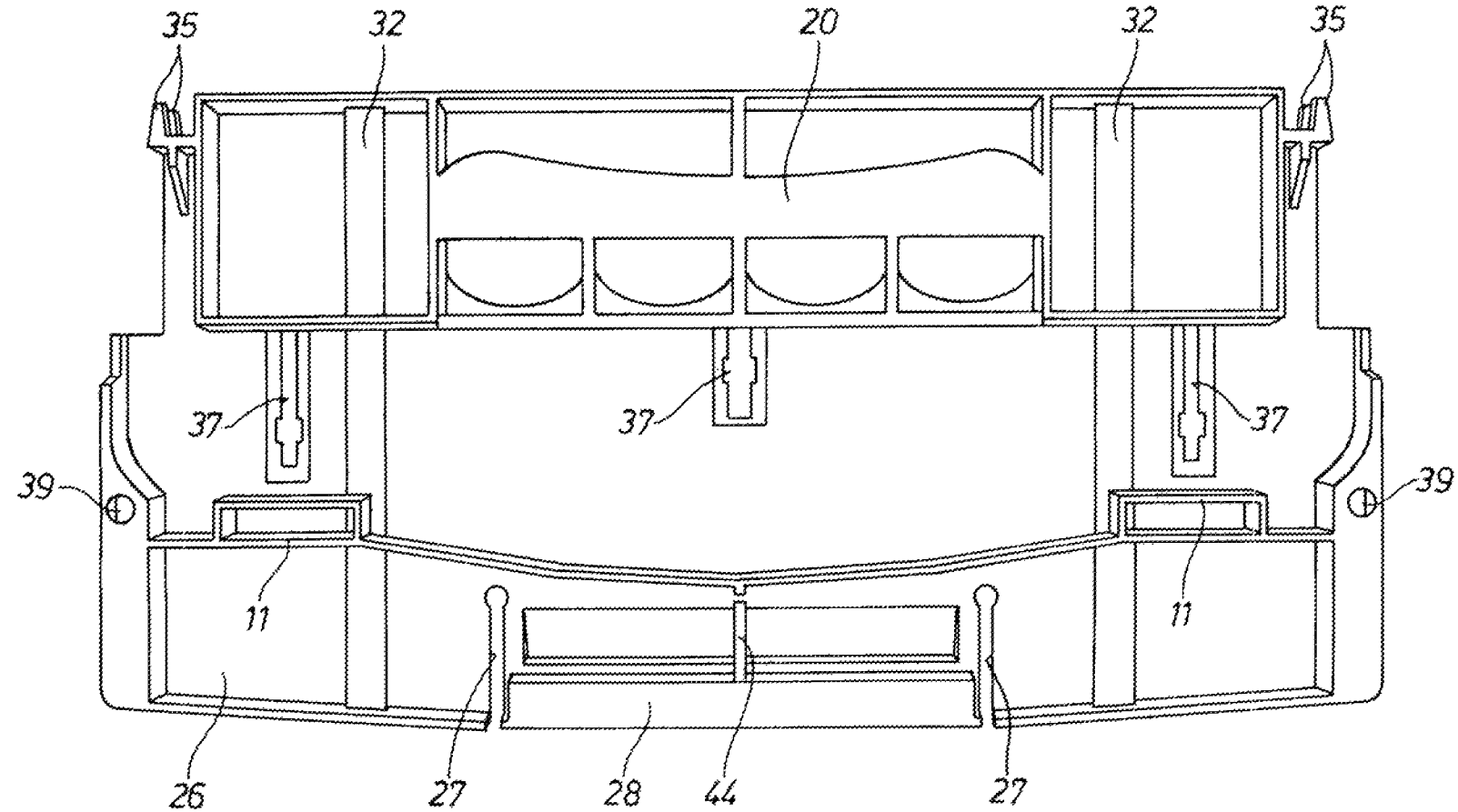
FIG. 5 is a detail front view from outside of the sliding wall panel not equipped with the actuating handle of the one-hand latch, viewed.
Figure 6:
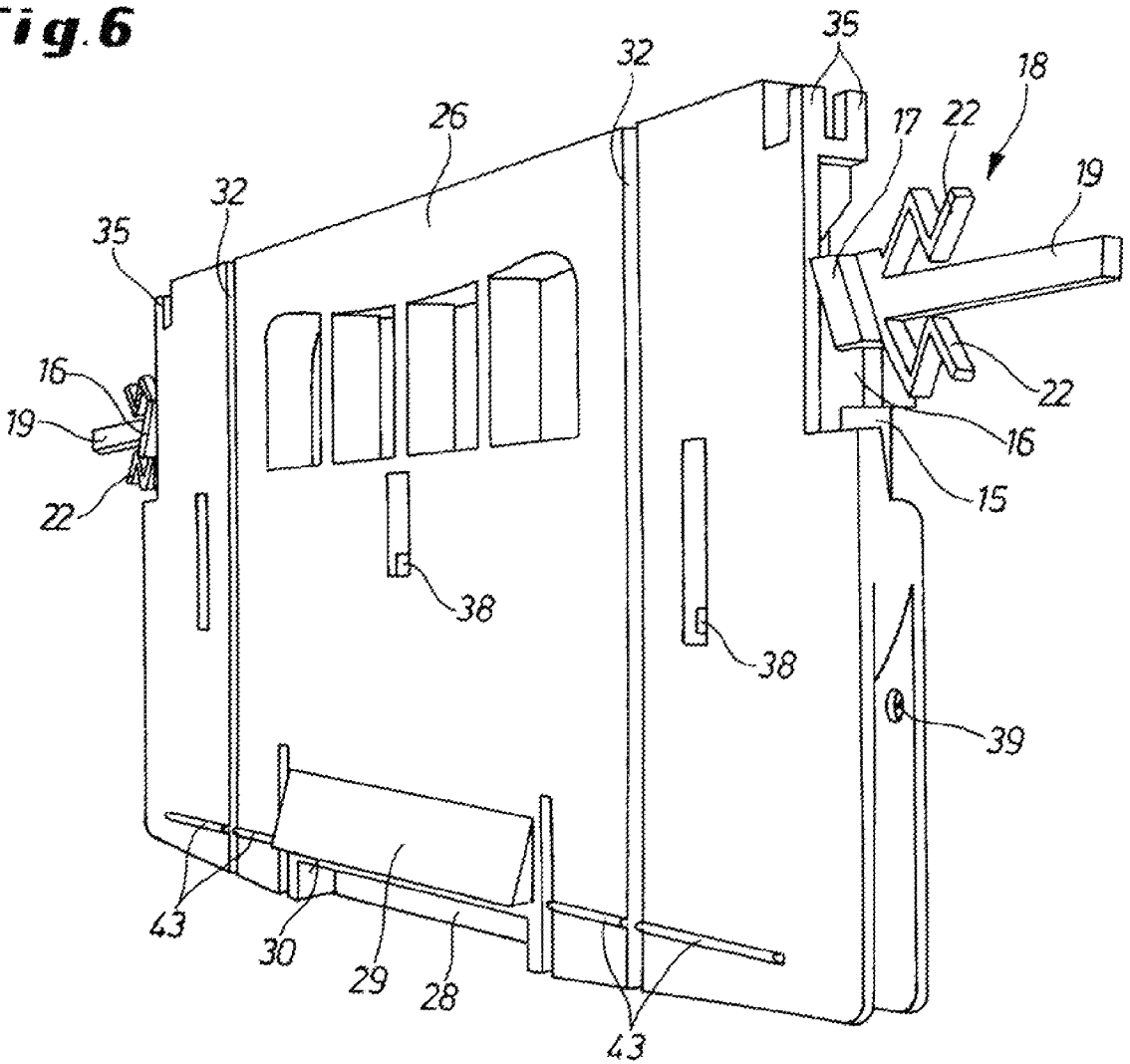
FIG. 6 is a perspective view from inside of the sliding wall panel equipped with the one-hand latch.

The sliding wall panel 26 shown in detail in FIGS. 5 and 6 has a handle recess 28 made flexible by cutouts in the form of vertical slots 27, which handle recess is formed on its inner face (FIG. 6) with a wedge-shaped overhang 29 angled outward going upward. In the raised end position of the sliding wall panel 26 closing the wall cutout 24, this overhang bears with its lower edge 30 against an edge 31 of the wall cutout 24. By gripping under or engaging into the handle recess 28, it can be pulled forward and the overhang 29 can thus be pulled away from the end edge 31 so that the sliding wall panel 26 thereafter can be displaced into its lower end position exposing the wall cutout 24. On the outside of the sliding wall panel 26, a stop 44 in the center between the vertical slots 27 extends from an upper edge of the handle recess 28 upward with approximately the length of the vertical slots. This forms a stop restricting the flexibility of the handle recess 28 and limits the movement thereof forward. The handle recess thus cannot be overextended.

To assist the lateral guides 25*a* and 25*b* during displacement movements, inwardly open guide grooves 32 provided on the sliding wall panel 26 are engaged by respective vertical ribs 33 formed on the outside of the end walls 4 and 5 extending to lower edges thereof. A recess 34 in the end wall receives the overhang 29 in the lower end position of the sliding wall panel 26. The overhang 29 or the handle recess 28 is thus not permanently stressed, which means material fatigue effects can be avoided. Furthermore, the recess 34 prevents the sliding wall panel 26, located in the lower end position, from automatically moving into the upper end position when the container 1 is inverted. Furthermore, this makes it possible to prevent the sliding wall panel 26 from being pushed up or tilted by shaking on automatic conveyors such as are conventionally used in automatic small-parts stores. The guide grooves 32 also counteract tilting with the vertical ribs 33 engaged therein.

Figure 2:
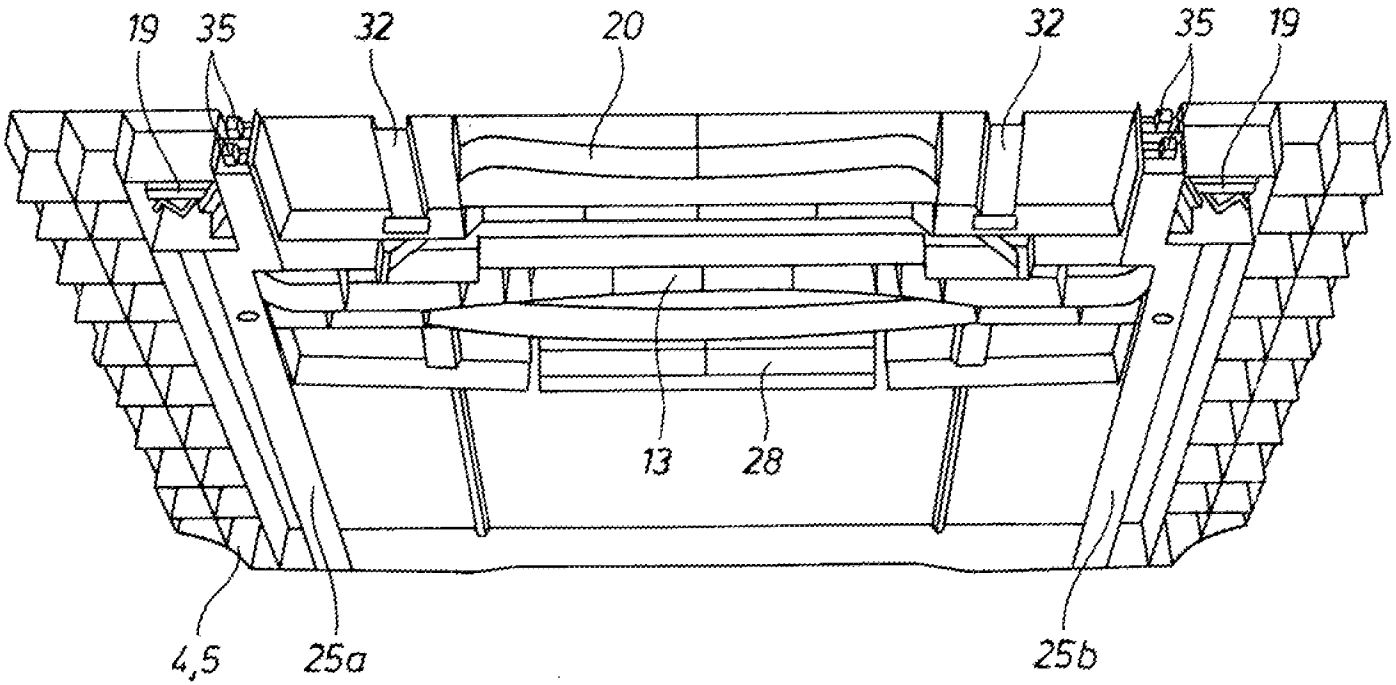
FIG. 2 is a perspective front-view detail of FIG. 1 of a container end wall, at the head end in longitudinal section.

The sliding wall panel 26 has sliding wall lugs 35 formed as pins projecting upward from its upper corners and fitting lugs in the raised end position of the sliding wall panel 26 into cavities or openings of the respective lateral guides 25*a* and 25*b* of the end walls 4 and 5 adjacent the wall cutout 24 (see FIG. 2). To this end, the end walls 4 and 5 are provided on sides of the upper portion of the wall cutout 24 with respective offset support shoulders 36 facing toward one another projecting somewhat into the wall cutout 24 (see also FIG. 8) that at the same time are also part of the lateral guides 25*a* and 25*b*. The offset support shoulders 36 distribute forces during handling of the container 1 under load from the sliding wall panel 26 into the end wall 4 and 5 that is thus stabilized. Not only are tensile forces absorbed that occur during carrying of the container, but also the pressure occurring on the upper edge of the container when several containers are stacked on top of or above one another.

The sliding wall panel 26 furthermore has parallel spaced and throughgoing slots 37 into which hook-shaped mounting heads 38 of the Arcuate actuating handle 13 are engaged during preassembly of the sliding wall panel 26 (see FIG. 6). When the actuating handle 13 is inserted with the mounting heads 38 into the throughgoing slots 37 it cannot fall out.

The sliding wall panel 26 is furthermore provided in the guides 25*a* and 25*b* of the end walls 4 and 5 with holes 39 in which antitamper seals 40 (see FIG. 7) can engage that also fit in the raised end position of the sliding wall panel 26 in holes 41 (see 4). When several filled containers are stacked one above the other in a rack, the antitamper seals provides theft protection. Unauthorized persons cannot in fact easily displace the sliding wall panel 26 into the opened end position with free access to the interior of the container. This would require removal of the seal 40, which cannot be carried out without leaving proof of tampering.

Figure 7:
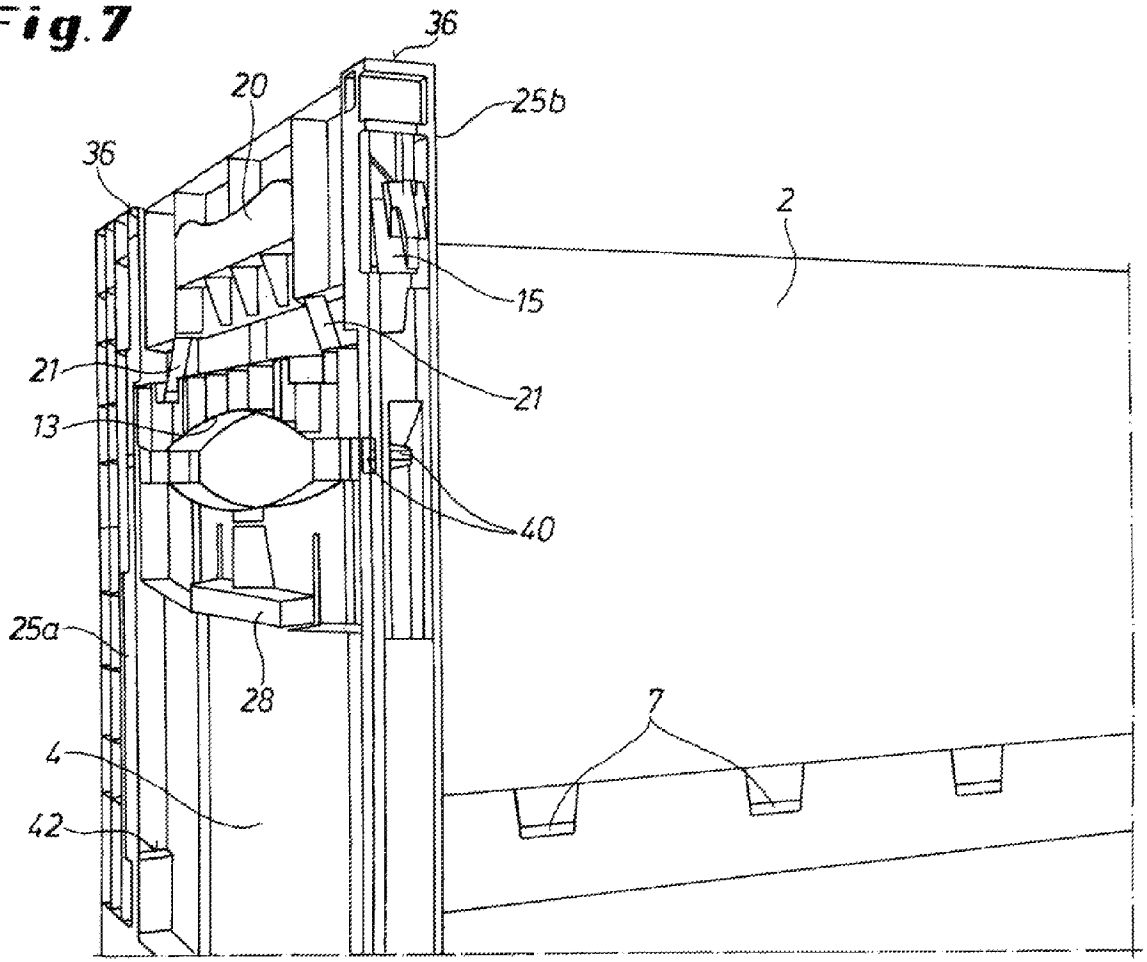
FIG. 7 is a perspective partial view of the container with the end wall in longitudinal section in the region of a lateral guide of the sliding wall panel.

For installation of the sliding wall panel 26 into the respective end wall 4 and 5, one of the lateral guides 25*a* and 25*b* is formed with an inset 42 shown in FIG. 7 on the lateral guide 25*a*. This inset 42 provides in the lateral guide 25*a* a pocket-like free space into which one vertical edge of the sliding wall panel 26 can be inserted with its guide profile facing toward the lateral guide 25*a*. The sliding wall panel 26 can thereafter be snapped by means of an opposite movement with the other guide profile of its other vertical edge into the other lateral guide 25*b*, whereby the sliding wall panel 26 is accommodated on both sides by the lateral guides 25*a* and 25*b*. The inset 42 extends only over a limited length of the lateral guide 25*a*, which ensures that the sliding wall panel 26 in the two end positions or also in intermediate positions is held in the lateral guides 25*a* and 25*b* without play. During sliding of the sliding wall panel 26, furthermore, the vertical ribs 33 of the end wall 4 and 5 accommodated in the guide grooves 32 of the sliding wall panel 26 reduce tolerances and tilting.

The wedge-shaped overhang 29 bears on the horizontal end edge 31 of the end walls 4 and 5 in the upper end position of the sliding wall panel 26 closing the wall cutouts 24 of the container 1. To expose a wall cutout 24, the handle recess 28 is pulled forward until the overhang 29 is spaced from the end edge 31. To prevent the sliding wall panel 26 from automatically sliding into the lower end position, there are slightly projecting ribs 43 (see FIG. 6) extending on both sides of the handle recess 28 at the level of the underside of the wedge 30 orthogonally to the vertical slots 27. They provide minimal resistance preventing automatic slipping. This resistance can be overcome by a small application of force, so that the sliding wall panel 26 subsequently can be displaced into the lower end position or into an intermediate position in a manually controlled manner. The actuating formations 16 of the handle ends 15 of the actuating handle 13 thereby slide out of the U-shaped guides 17 of the unlatching arm or the unlatching tongue 19 of the other parts of the motion-redirecting means remaining in the end wall.

To close the wall cutout 24 again, the sliding wall panel 26 needs only to be pulled upward, and as soon as the overhang 29 has moved above the horizontal end edge 31 of the wall cutout 24, while at the same time the handle ends 15 of the actuating handle 13 with their angled actuating formations 16 engage again into the U-shaped guide 17 of the motion-redirecting means, the overhang 29 automatically adopts its position projecting over the end edge 31 and holding the sliding wall panel 26 in position.

If the container walls are to be collapsed, however, in the closed end position of the sliding wall panels 26 in order to fold down the end walls 4 and 5 onto the container base 6 it is necessary to unlatch of the snap connection with the side walls 2 and 3 by lifting the actuating handle 13 by hand (in the upward direction 14 of FIG. 1). The actuating formations 16 accommodated fitting in the U-shaped guides 17 then slide upward, whereby associated therewith the unlatching element 18 with the unlatching arm 19 is deflected horizontally in the direction of the spring tongues 10. As a result, the spring tongues 10 are pressed outward and the end walls 4 and 5 are unlatched. When the actuating handle 13 is released, it is automatically pressed downward into the starting position by the resetting force of the prestressed spring tabs 21. At the same time an automatic return of the unlatching arms 19 takes place via spring arms 22 molded above and below the unlatching element 18 and supported on vertical reinforcement ribs 12, interacting with the spring tabs 21 of the actuating handle 13, so that the end walls [Translator's note: from DE 10 2009 033 108] snap in and automatically latch with the spring tongues 10 when the end walls are again swung up.

| List of reference numbers | |
|---|---|
| 1 | Container/box |
| 2 | Side wall |
| 3 | Side wall |
| 4 | End wall |
| 5 | End wall |
| 6 | Container base |
| 7 | Hinge |
| 8 | Flange (chamfer) |
| 9 | |
| 10 | Spring-tongue-like latching means/spring tongues |
| 11 | Horizontal reinforcement rib |
| 12 | Vertical reinforcement rib |
| 13 | Actuating handle |
| 14 | Lifting direction |
| 15 | Actuating handle end/handle end |
| 16 | Actuating formation (part of a motion-redirecting means) |
| 17 | U-shaped guide (another part of a motion-redirecting means) |
| 18 | Unlatching element |
| 19 | Unlatching arm/ tongue |
| 20 | Handle |
| 21 | Spring tab |
| 22 | Spring arm |
| 23 | Locking rib |
| 24 | Wall cutout |
| 25a and 25b | Lateral guide |
| 26 | Sliding wall element |
| 27 | Vertical slot |
| 28 | Handle recess |
| 29 | Overhang |
| 30 | Wedge lower edge |
| 31 | End edge |
| 32 | Guide groove |
| 33 | Vertical rib |
| 34 | Recess |
| 35 | Sliding wall lug |
| 36 | Offset support shoulder |
| 37 | Throughgoing slots |
| 38 | Mounting heads |
| 39 | Hole (of the sliding wall opening) |
| 40 | Seal |
| 41 | Hole (of the end wall) |
| 42 | Inset |
| 43 | Ridge |
| 44 | Stop |

The invention claimed is:

1. A box comprising:

a horizontal floor having side and end edges;

respective side and end walls at the side and end edges, each of the end walls being formed with an upwardly open cutout;

respective hinges pivoting each of the walls to the respective edge for movement between an erect position extending upward from the floor and a stowed position with the walls lying atop one another atop the floor;

respective spring tongues projecting from ends of the side walls and engageable with the end walls in the erect positions of the walls to hold the walls in the erect positions;

respective panels slidable on the end walls between respective upper closed positions closing the respective cutout and lower open positions exposing the respective cutout;

a respective actuating element vertically shiftable on an outer face of each of the panels;

respective links horizontally shiftable on the outer face of each of the end walls to each side of the respective cutouts and outwardly engageable with the respective tongues to press same outward out of engagement with the end walls in the erect positions of the walls; and respective pairs of interengaging angled cam formations on ends of the actuating elements and on the links of the respective end wall for redirecting motion and pushing the links into the outer position when the respective actuating elements are moved upward.

2. The box according to claim 1, wherein the horizontally shiftable links are each formed on upper and lower faces with spring arms bearing on the respective end wall.

3. The box according to claim 1, wherein the panels are unitarily formed at their lower edges with respective flexible handle recesses each formed with an overhang directed inwardly into the box and, in a position closing the respective cutout, sitting on a horizontal end edge of the respective wall cutout.

4. The box according to claim 3, wherein the overhangs are each angled upward and outward in a wedge-shaped manner.

5. The box according to claim 3, wherein the handle recess is above outer horizontally spaced vertical slots formed in the panel.

6. The box according to claim 5, further comprising a respective stop mounted on each panel above the respective handle recess approximately in the center between the respective vertical slots, establishing the maximum freedom of movement of the handle recess with tensile impingement.

7. The device box according to claim 5, further comprising straight ridges on the inside of each panel orthogonally to the vertical slots provided at the height of the surface of the overhang bearing on the end edge of the wall cutout.

8. The box according to claim 3, wherein a recess in the respective end wall can receive the overhang in the lower end position of the panel.

9. The device box according to claim 1, wherein each panel over its entire height has guide grooves opening inward and spaced apart from one another aligned with vertical ribs formed on the outside of the end wall extending up to the lower edge thereof and engaging into the guide grooves.

10. The box according to claim 1, wherein the lateral guides of the end wall at the upper end of the wall cutout are formed with respective offset support shoulders facing toward one another and have downwardly open cavities into which sliding wall lugs molded projecting upward from the upper corners of the panel can engage in the raised end position.

11. The box according to claim 10, wherein one lateral guide is formed over part of its height below the wall cutout with an inset.

12. The box according to claim 10, wherein the lateral guides and the panel are provided with holes that in the raised end position of the panel are aligned for attachment of an antitamper seal.

13. The box defined in claim 1, further comprising spring means for urging the actuating elements into the lower positions.

14. The box defined in claim 13, wherein the spring means is a spring finger bearing on the respective panel and unitarily formed of plastic with the respective actuating element.

15. The box defined in claim 1, further comprising spring means for urging the links inward and away from the respective tongues.

16. The box defined in claim 1 wherein each pair of cam formations includes a straight angled face on each end of each of the actuating elements and a complementarily angled straight angled face on each of the links, the angled faces sliding on each other and camming out the links on raising of the respective elements.

* * * * *